US011639786B2

(12) United States Patent
Zhang et al.

(10) Patent No.: US 11,639,786 B2
(45) Date of Patent: May 2, 2023

(54) LIGHTING DEVICE

(71) Applicant: OPPLE LIGHTING CO., LTD., Shanghai (CN)

(72) Inventors: Hu Zhang, Shanghai (CN); Zhanguo Liu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 383 days.

(21) Appl. No.: 16/908,678

(22) Filed: Jun. 22, 2020

(65) Prior Publication Data

US 2020/0400288 A1 Dec. 24, 2020

(30) Foreign Application Priority Data

Jun. 24, 2019 (CN) ..... 201920951810.3
Jun. 24, 2019 (CN) ..... 201920951833.4

(51) Int. Cl.

| | |
|---|---|
| ***F21V 17/18*** | (2006.01) |
| ***F21V 3/02*** | (2006.01) |
| ***F21V 17/16*** | (2006.01) |
| ***F21Y 105/18*** | (2016.01) |
| ***F21V 31/00*** | (2006.01) |
| ***F21V 23/06*** | (2006.01) |
| ***F21V 23/02*** | (2006.01) |
| ***F21V 23/00*** | (2015.01) |
| ***F21V 23/04*** | (2006.01) |

(52) U.S. Cl.

CPC ..... *F21V 17/18* (2013.01); *F21V 3/02* (2013.01); *F21V 17/164* (2013.01); *F21V 23/006* (2013.01); *F21V 23/02* (2013.01); *F21V 23/0442* (2013.01); *F21V 23/06* (2013.01); *F21V 31/005* (2013.01); *F21Y 2105/18* (2016.08)

(58) Field of Classification Search

CPC ..... F21V 17/164; F21V 17/18; F21V 3/02; F21V 23/02; F21V 23/0442; F21V 23/06

See application file for complete search history.

(56) References Cited

U.S. PATENT DOCUMENTS

2016/0356432 A1* 12/2016 Scribante ..... F21V 17/18

OTHER PUBLICATIONS

Notice of First Review in Chinese Application No. 201920951810.3 dated Nov. 12, 2019, (2p).

* cited by examiner

*Primary Examiner* — Thomas M Sember
(74) *Attorney, Agent, or Firm* — Arch & Lake LLP

(57) ABSTRACT

The present disclosure discloses a lighting device, including a base, a cover and a lighting module, the cover is disposed on the base, and a receiving chamber is formed between the cover and the base; the lighting module includes a light source module and a driving power source, the light source module is rotatably disposed on a side wall of the base, the driving power source is disposed in the receiving chamber, and the light source module is connected with the driving power source.

20 Claims, 9 Drawing Sheets

LIGHTING DEVICE

CROSS-REFERENCE TO RELATED APPLICATIONS

This application is based upon and claims the priority of the Chinese patent application No. 201920951833.4 filed on Jun. 24, 2019 and the Chinese patent application No. 201920951810.3 filed on Jun. 24, 2019, the entire content of all of which is hereby incorporated by reference herein for all purposes.

TECHNICAL FIELD

The present disclosure relates to the field of lighting technology, and particularly to a lighting device.

BACKGROUND

There are many types of lighting devices, such as hanging lamps, ceiling lamps, floor lamps, wall lamps, spot lights and the like.

SUMMARY

The present disclosure provide a lighting device.

According to the present disclosure, a lighting device is provided. The lighting device includes: a base, a cover and a lighting module. The cover may be disposed on the base, and a receiving chamber may be formed between the cover and the base. The lighting module may include a light source module and a driving power source, the light source module may be rotatably disposed on a side wall of the base, the driving power source may be disposed in the receiving chamber, and the light source module, may be connected with the driving power source.

It is to be understood that both the foregoing general description and the following detailed description are exemplary and explanatory only and are not restrictive of the present disclosure.

BRIEF DESCRIPTION OF THE DRAWINGS

The drawings that constitute a part of the present disclosure are described herein to provide further understanding of the present disclosure. The examples of the present disclosure and the description thereof are used for explaining the present disclosure but do not constitute any undue limitation on the present disclosure. In the drawings.

DETAILED DESCRIPTION

Figure 1:
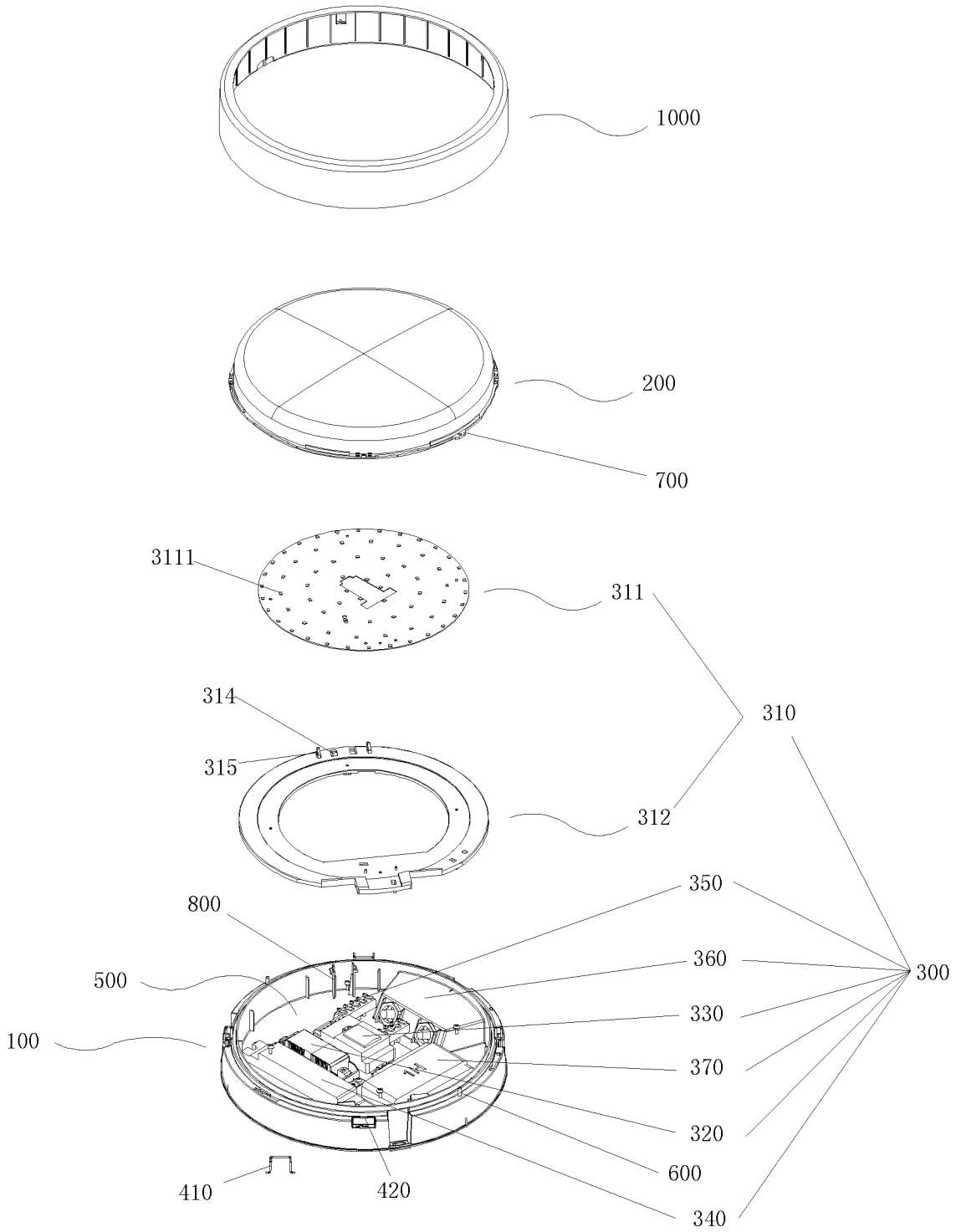
FIG. 1 is a structurally exploded view of a lighting device.
Figure 2:
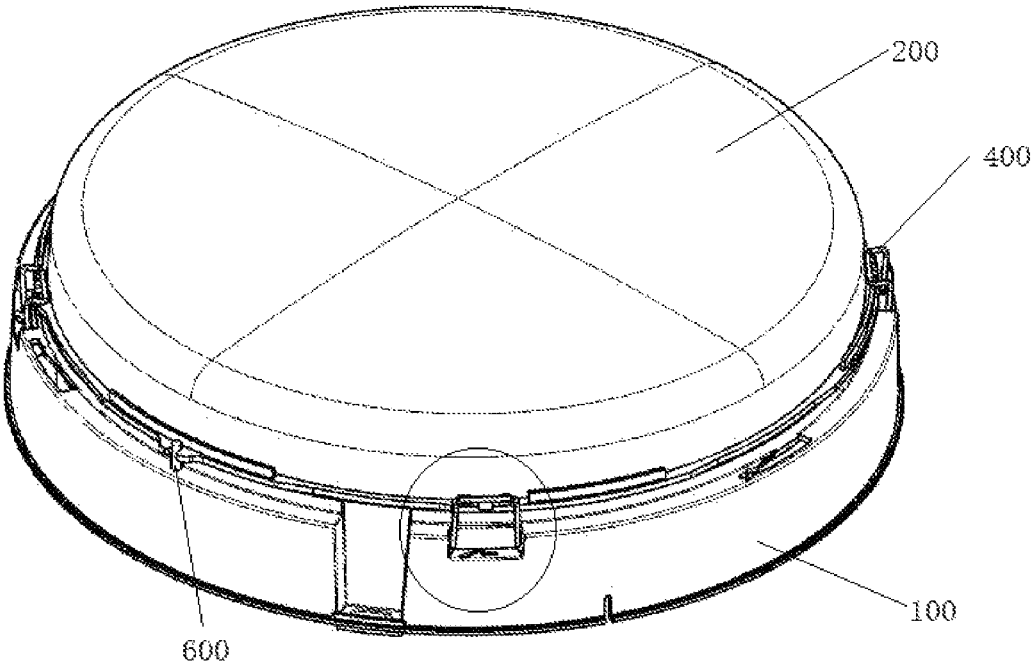
FIG. 2 is a structural diagram of a lighting device.
Figure 3:
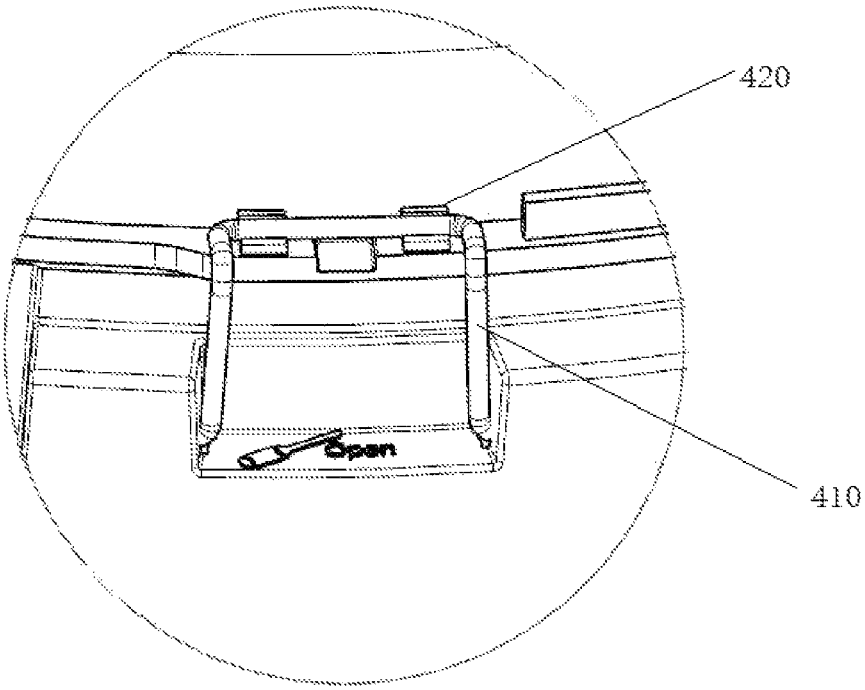
FIG. 3 is a partially structural diagram of FIG. 2.
Figure 4:
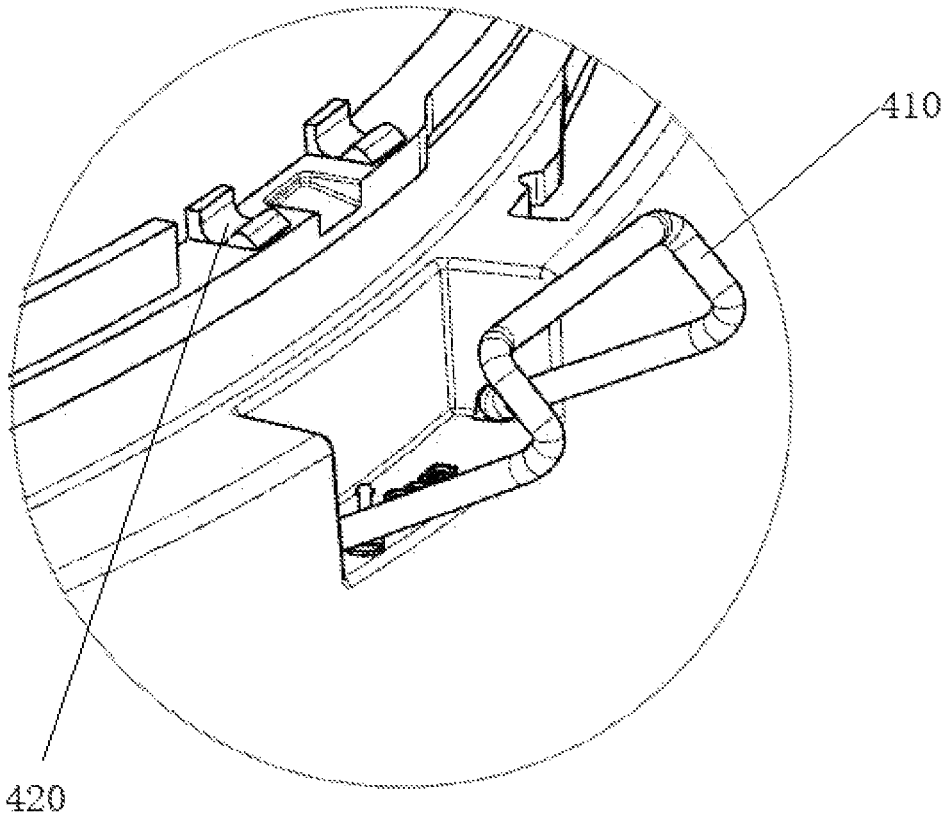
FIG. 4 is a structural diagram of a buckle in FIG. 3 when the buckle is in an opened state.

In order to make objectives, technical details and advantages of the present disclosure clear, the technical solutions of the present disclosure are described in a clearly and fully understandable way in connection with examples of the present disclosure and corresponding drawings. Apparently, the described examples are just a part but not all of the examples of the present disclosure. Based on the examples described in the present disclosure, those ordinary skilled in the art can obtain all other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The technical solutions provided by the examples of the present disclosure are described in details below in conjunction with the drawings.

The reference numerals referred in this disclosure include: 100—base, 101—side wall, 102—bottom wall, 200—cover, 300—lighting module, 310—light source module, 311—light source substrate, 3111—light source element, 312—rotatable support, 313—rotation shaft, 314—through hole, 315—handle pulling member, 320—driving power source, 330—sensor, 340—inverter, 350—wiring terminal, 360—adapter connector, 370—battery, 400—press-locking mechanism, 410—buckle, 420—snap-fitting slot, 500—receiving chamber, 600—positioning mechanism, 700—positioning bracket, 800—snap-fitting block, 801—pillar, 802—protrusion, 900—sealing ring, 1000—housing.

Sometimes, a light source module and a lamp housing of the lighting device are fixedly connected by screws, and both the installation and disassembly are very troublesome. Especially, for waterproof wall lamps installed with functional control modules, they need to be fixed to the wall with screws during construction. After the installation is completed, a light source board is opened by removing the screws, and the functional control modules are adjusted. After adjustment, the removed screws are installed to the waterproof wall lamps, again. This process includes repetitive works, which wastes time and manpower and involves the problem that the installation and removal are troublesome.

As illustrated in FIG. 1, a lighting device provided by an example of the present disclosure includes: a base 100, a cover 200, a lighting module 300, and at least one press-locking mechanism 400. The cover 200 is disposed on the base 100; a receiving chamber 500 is formed between the cover 200 and the base 100; and the lighting module 300 is disposed in the receiving chamber 500. One end of the press-locking mechanism 400 is disposed on the cover 200, and the other end of the press-locking mechanism 400 is rotatably locked on the base 100. The press-locking mechanism is used for detachably connecting the cover 200 with the base 100. In another example of the present disclosure, one end of the press-locking mechanism 400 may be provided on the base 100, and the other end of the press-locking mechanism 400 may be rotatably locked on the cover 200. During installation, the cover 200 and the base 100 are connected through the press-locking mechanism 400; and during disassembly, one end of the press-locking mechanism 400 is detached from the cover 200 or detached from the base 100 so as to achieve the purpose of separating and disassembling the cover 200 from the base 100. In this way, the installation and disassembly are easier to be achieved, thereby improving the work efficiency and reducing the labor cost.

As illustrated in FIG. 2 to FIG. 7, in an example of the present disclosure, the press-locking mechanism 400 includes a buckle 410 and a snap-fitting slot 420, one end of the buckle 410 is rotatably disposed on the base 100, and the snap-fitting slot 420 is disposed on the cover 200. The cover 200 is configured to be mounted on the base 100 by snap-fitting the other end of the buckle 410 in the snap-fitting slot 420; and the cover 200 is configured to be detached from the base 100 by disengaging the buckle 410 from the snap-fitting slot 420 through rotating the buckle 410. The present disclosure realizes a sealing effect through the cooperative use of the buckle and the snap-fitting slot 420, and the structure is simple. The buckle 410 of the present disclosure may adopt a spring clamp structure.

In an example of the present disclosure, the buckle 410 is evenly arranged on the cover 200 along a circumferential structure of the cover 200; or the buckle 410 is evenly arranged on the base 100 along a circumferential structure of the base 100. In an example of the present disclosure, four press-locking mechanisms 400 are provided, and are symmetrically arranged. This structure allows the base 100 and the cover 200 to be more tightly connected, and allows the base 100 and the cover 200 to be evenly stressed.

Figure 8:
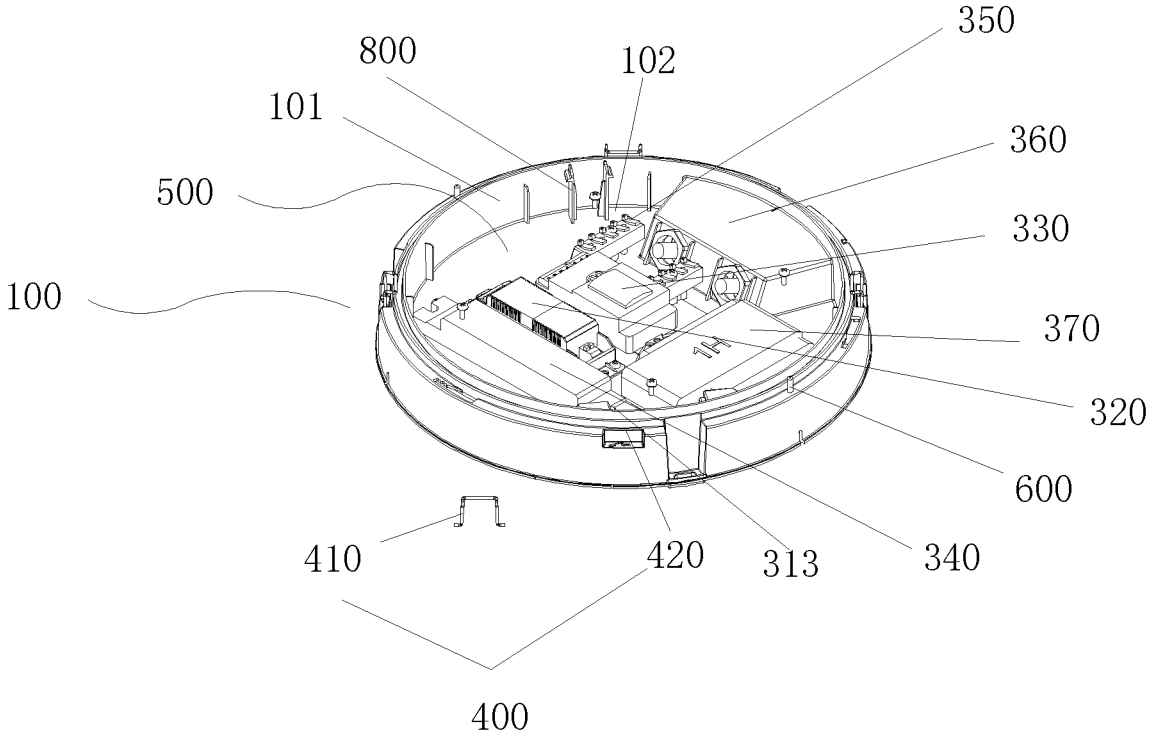
FIG. 8 is an internally structural diagram of a base.

As illustrated in FIG. 8, in an example of the present disclosure, the lighting device further includes at least one positioning mechanism 600 provided between two adjacent press-locking mechanisms 400, and the positioning mechanism 600 is used for positioning the cover 200 and the base 100 so that the installation of the cover 200 and base 100 is easier to be achieved.

Figure 9:
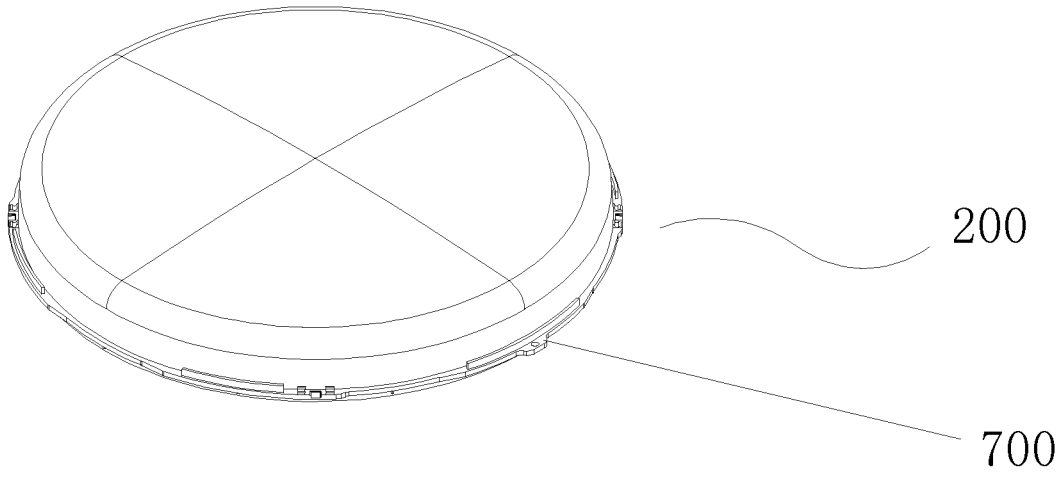
FIG. 9 is a structural diagram of a cover.

As illustrated in FIG. 9, in an example of the present disclosure, a positioning bracket 700 is provided on the cover 200 or on the base 100. The positioning mechanism 600 as illustrated in FIG. 8 is a connecting member, the positioning bracket 700 is disposed on the cover 200, one end of the connecting member is connected to the positioning bracket 700 and the other end of the connecting member is connected to the base 100 correspondingly. In an example of the present disclosure, the positioning bracket 700 and the cover 200 are integrally formed, and the positioning bracket 700 is provided with a positioning hole, so that the positioning mechanism 600 can penetrate the positioning hole to be connected with the positioning hole. In another example of the present disclosure, the positioning bracket 700 is disposed on the base 100, one end of the connecting member is connected to the positioning bracket 700 and the other end of the connecting member is correspondingly connected to the cover 200.

Figure 10:
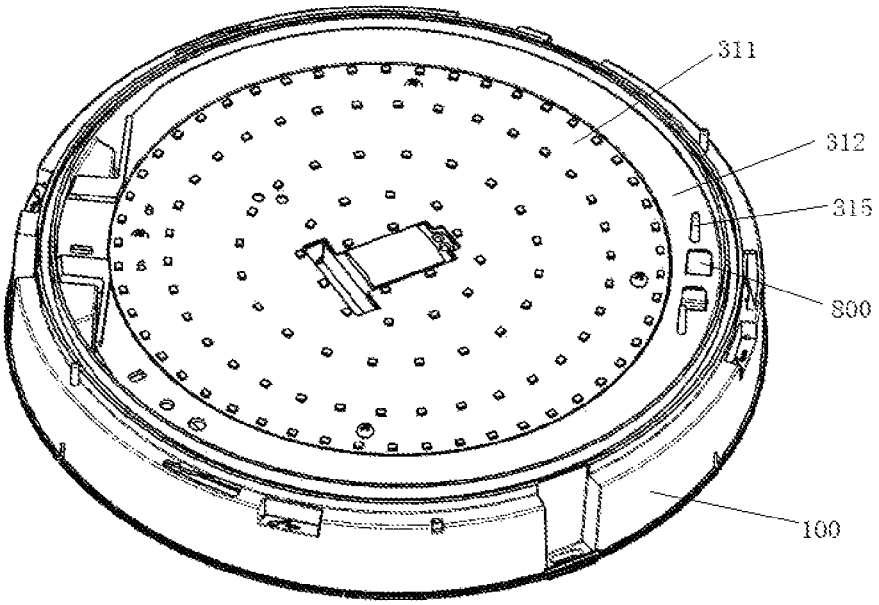
FIG. 10 is a structural diagram of a rotatable support and a base that are in a closed state.
Figure 11:
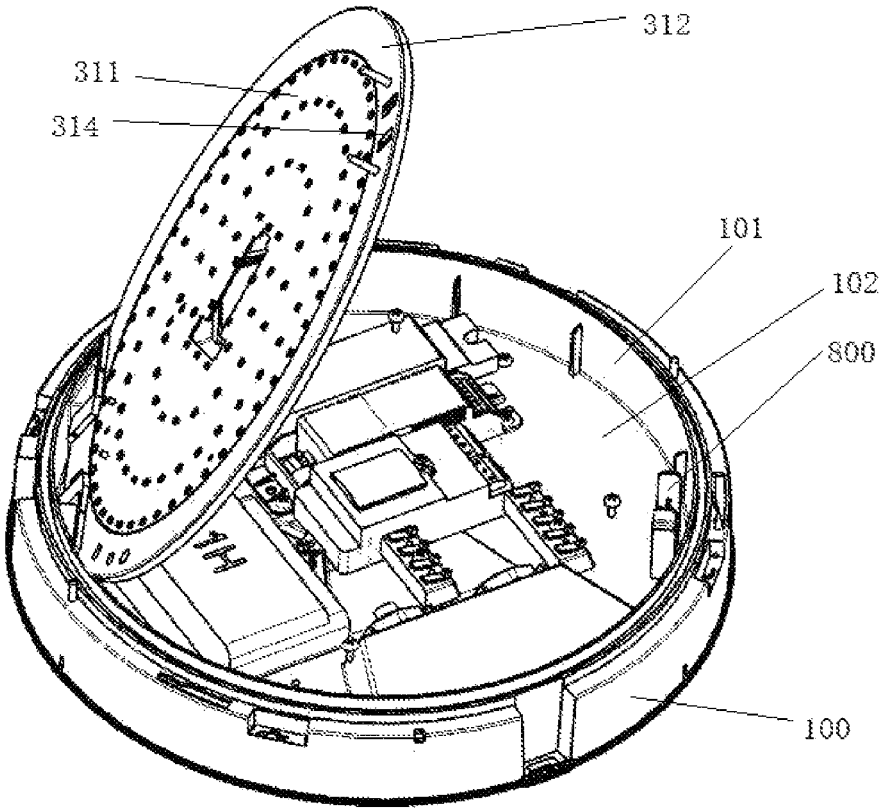
FIG. 11 is a structural diagram of a rotatable support and a base that are in an opened state.

As illustrated in FIG. 8, in an example of the present disclosure, the lighting module 300 includes a light source module 310 and a driving power source 320. As illustrated in FIG. 10 and FIG. 11, the light source module 310 is rotatably disposed on a side wall 101 of the base 100, the driving power source 320 is disposed in the receiving chamber 500, and the light source module 310 is connected with the driving power source 320. In another example of the present disclosure, the light source module 310 is disposed on the side wall 101 of the base 100 through fixing members such as screws. The light source module 310 is opened or closed by rotating the light source module 310, which is convenient for adjusting a functional structure in the base 100 with the advantages of easy disassembly and installation, and the operation is more convenient and faster.

As illustrated in FIG. 11, in an example of the present disclosure, the light source module 310 includes a light source substrate 311 and a rotatable support 312. One end of the rotatable support 312 is rotatably disposed on the side wall 101 of the base 100, and the other end of the rotatable support 312 is snap-fitted with the side wall 101 of the base 100. The light source substrate 311 is disposed on the rotatable support 312. Because the light source substrate 311 is not suitable to be stressed, a rotatable support 312 is provided at an outer side of the light source substrate 311, and the light source substrate 311 is opened by applying a force to the rotatable support 312, which can effectively avoid a deformation of the light source substrate 311, extend the service life, and achieve a better illuminating effect.

Figure 12:
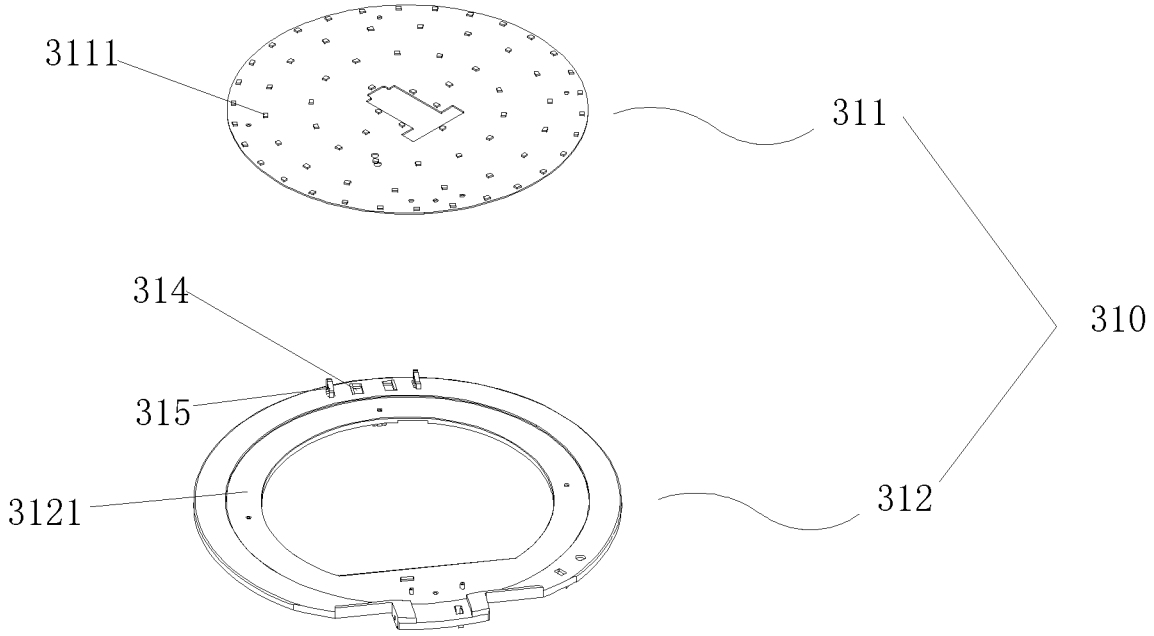
FIG. 12 is a structurally exploded view of a light source module.

As illustrated in FIG. 12, in an example of the present disclosure, along a direction from the cover 200 to the base 100, the rotatable support 312 includes a stepped double-ring structure in which an inner ring is recessed; and the light source substrate 311 is disposed on the inner ring 3121 of the rotatable support 312. In this application, the rotatable support 312 is configured as an internally recessed double-ring structure, and the inner ring 3121 serves to support the light source substrate 311; in this way, it further prevents from a deformation of the light source substrate 311, and a connection between the rotatable support 312 and the light source substrate 311 is more stable. In an example of the present disclosure, a plurality of light source elements 3111 is provided on the light source substrate 311.

Figure 13:
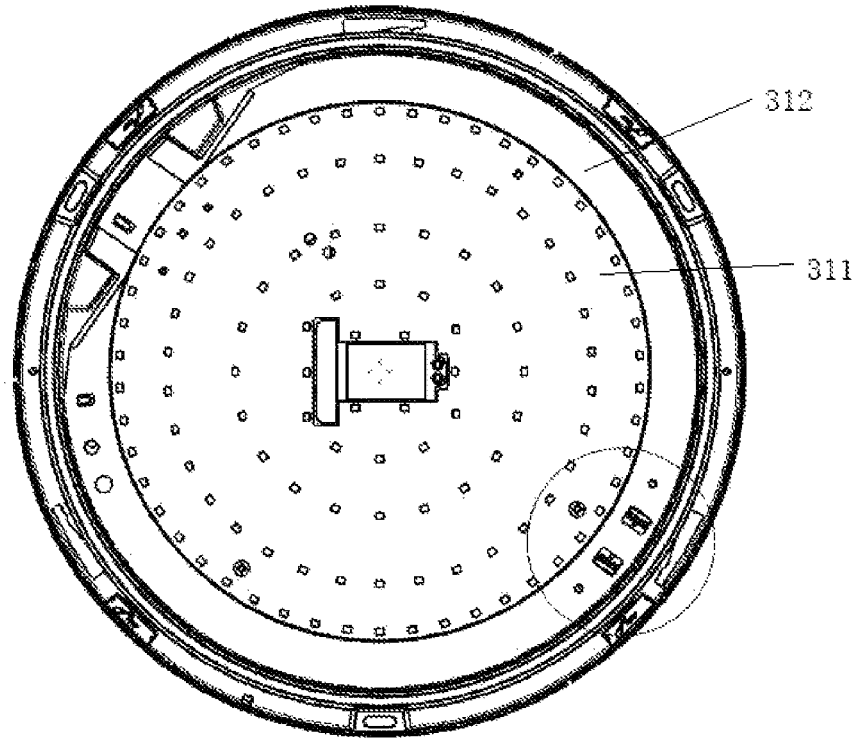
FIG. 13 is a plan view of a rotatable support and a base.
Figure 14:
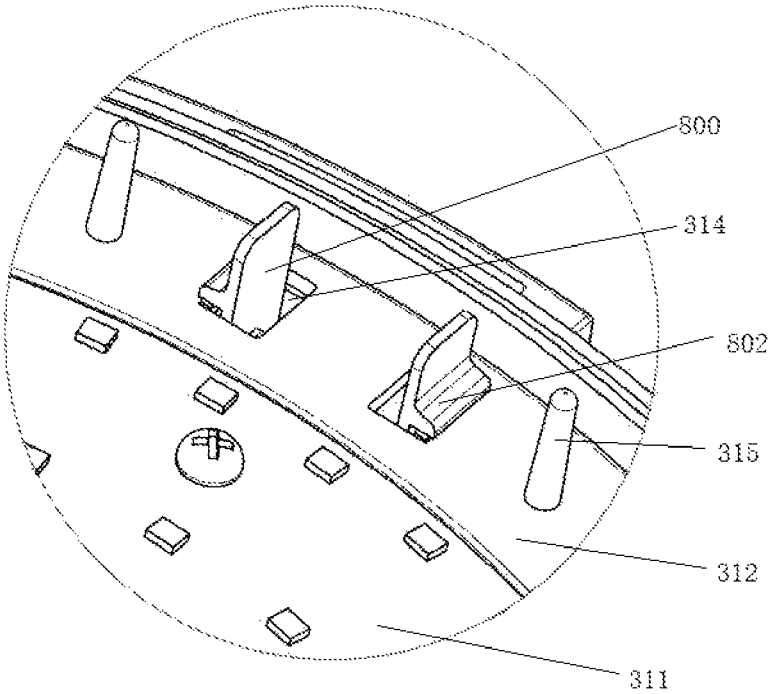
FIG. 14 is a partially structural diagram of FIG. 13.

As illustrated in FIG. 13 and FIG. 14, in an example of the present disclosure, the rotatable support 312 is disposed on the side wall 101 of the base 100 through a rotation shaft 313 as illustrated in FIG. 8; a snap-fitting block 800 is provided on the side wall 101 of the base 100 opposite to the rotation shaft 313 as illustrated in FIG. 8; a through hole 314 is provided on the rotatable support 312; and the snap-fitting block 800 is snap-fitted in the through hole 314. In this application, when the rotatable support 312 and the base 100 are in a closed state, the rotatable support 312 is blocked and stopped by the snap-fitting block 800 through the cooperation between the snap-fitting block 800 and the through hole 314, thus the rotatable support 312 will not be detached from the base 100, and the connection between the rotatable support 312 and the base 100 is more stable; furthermore, the rotatable support 312 is in a flat state, which reduces a curved radian of the rotatable support 312 when it's bent and allows the light source substrate 311 to be in a better working state.

Figure 15:
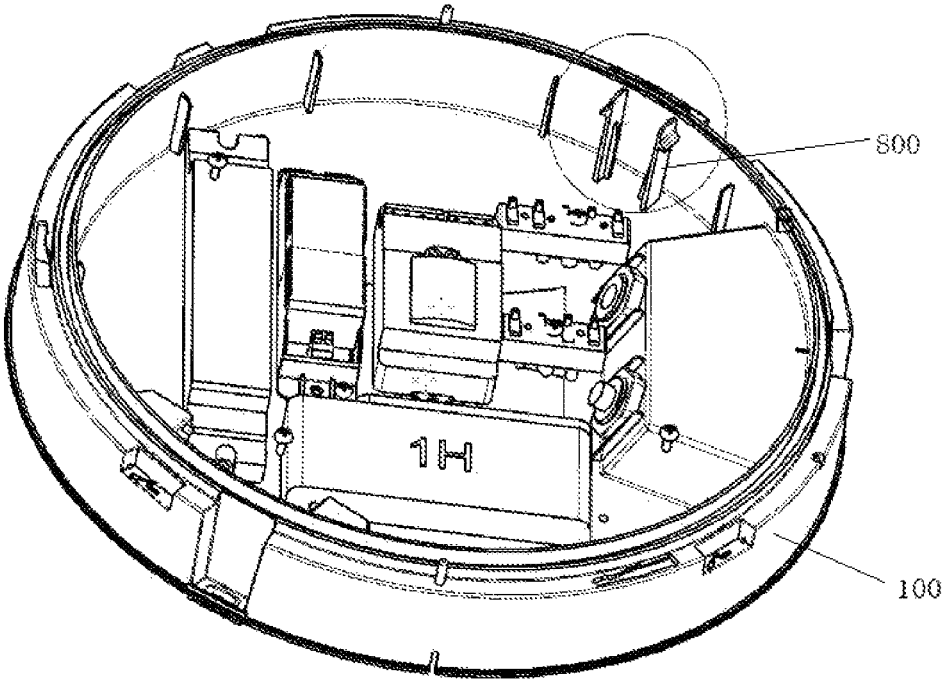
FIG. 15 is an internally structural diagram of a base.
Figure 16:
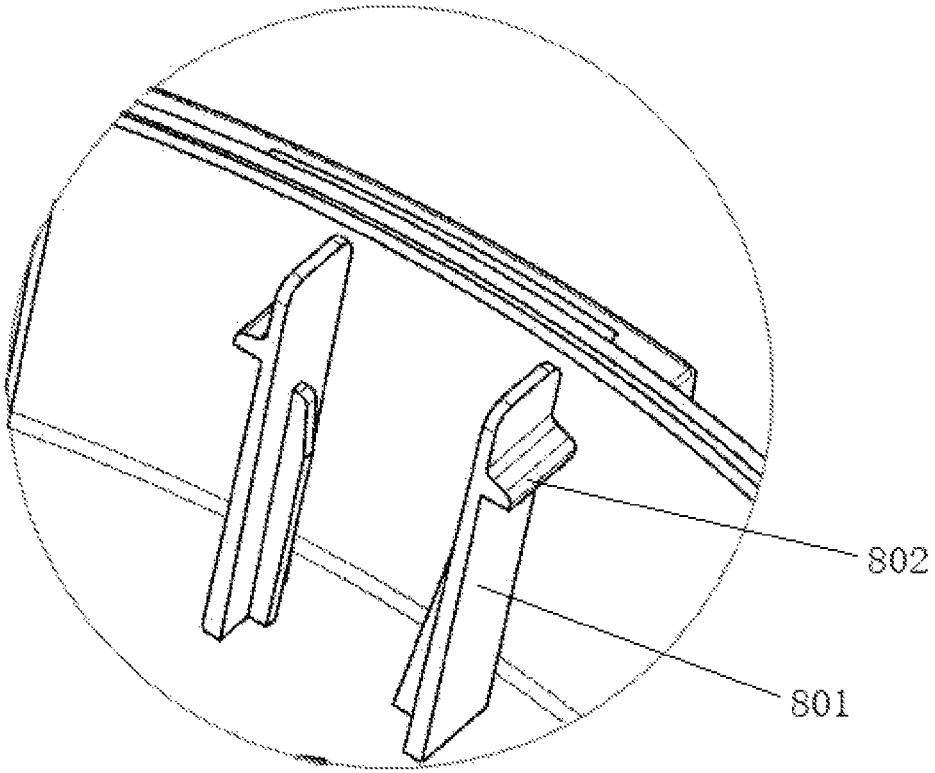
FIG. 16 is a partially structural diagram of FIG. 15.

In an example of the present disclosure, the snap-fitting block 800 has an elastic structure. By providing the snap-fitting block 800 as an elastic structure, in the case where the rotatable support 312 needs to be adjusted from a closed state with respect to the base 100 as illustrated in FIG. 10 to an opened state with respect to the base 100 as illustrated in FIG. 11, the snap-fitting block 800 may pass through the through hole 314 as illustrated in FIG. 11 by pushing the snap-fitting block 800, and then the rotatable support 312 may be opened with respect to the base 100 by rotating the rotation shaft 312 as illustrated in FIG. 8 in the direction from the base 100 to the cover 200, thus the arrangement is more scientific and the operation is easier. In an example of the present disclosure, two snap-fitting blocks 800 are provided, thus the arrangement is more symmetrical, and the connection is more stable. As illustrated in FIG. 15 and FIG. 16, the snap-fitting block 800 includes a pillar 801 and a protrusion 802; one end of the pillar 801 is disposed on a bottom wall 102 of the base 100; the protrusion 802 is connected to the pillar 801 and is perpendicular to the pillar 801; a bottom surface 803 of the protrusion 802 is slightly higher than the through hole 314; and the rotatable support 312 is snap-fitted with the base 100 through the protrusion 802.

As illustrated in FIG. 14, in an example of the present disclosure, a handle pulling member 315 is provided on the rotatable support 312. In the present disclosure, when the rotatable support 312 needs to be adjusted from a closed state to an opened state with respect to the base 100, the rotatable support 312 can be opened more quickly by pulling the handle pulling member 315 upwards in a direction from the base 100 to the cover 200. In an example of the present disclosure, the handle pulling member 315 is a columnar mechanism or an inverted U-shaped structure.

Figure 5:
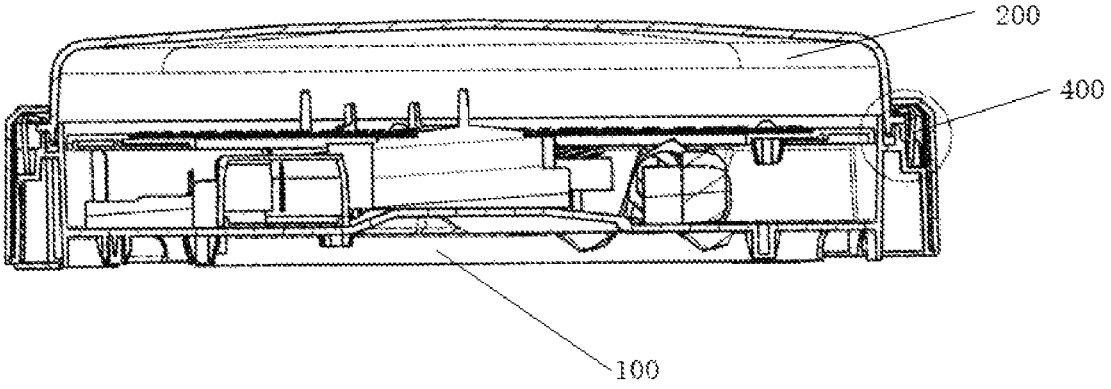
FIG. 5 is a cross-sectional view of a lighting device.
Figure 6:
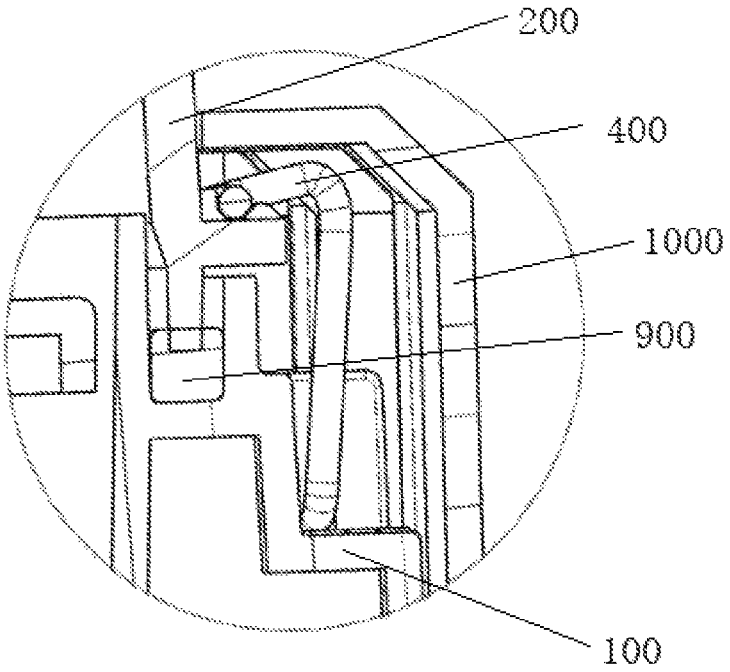
FIG. 6 is a partially structural diagram of FIG. 5.
Figure 7:
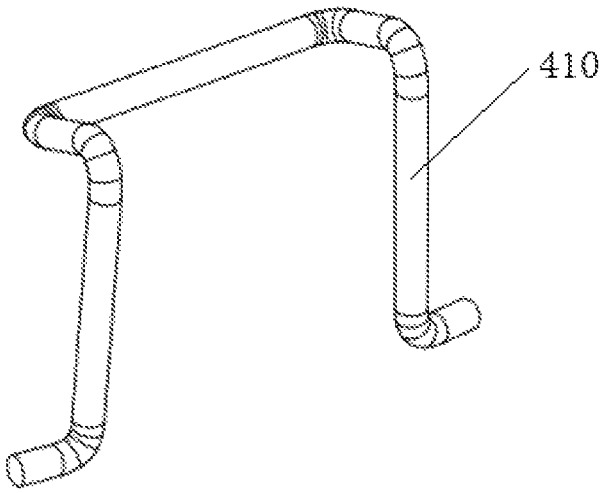
FIG. 7 is a structural diagram of a buckle.

As illustrated in FIG. 5 and FIG. 6, in an example of the present disclosure, the lighting device further includes a sealing ring 900 disposed between the cover 200 and the base 100, and the press-locking mechanism 400 presses against the sealing ring 900 to position the sealing ring 900 between the cover 200 and the base 100. The sealing ring 900 is provided to improve the sealing effect of the lighting device so that the lighting device is more waterproof.

As illustrated in FIG. 1, in an example of the present disclosure, the lighting device further includes a housing 1000 disposed outside the base 100 and the press-locking mechanism 400 to cover the base 100 and the press-locking mechanism 400 in a circumferential direction. By providing the housing 1000, the press-locking mechanism 400 is hidden in the housing 1000, and the appearance is more aesthetic. The housing 1000 may be connected to the base 100 through screw threads or snap-fitters.

As illustrated in FIG. 8, in the present disclosure, a functional module can be provided according to the needs of functions. In an example of the present disclosure, the lighting module 300 further includes at least one selected from the group consisting of: a sensor 330, an inverter 340, a wiring terminal 350, an adapter connector 360 and a battery 370. The sensor 330, the inverter 340, the wiring terminal 350, the adapter connector 360 and the battery 370 are all disposed in the receiving chamber 500, and are all connected with the driving power source 320.

In an example of the present disclosure, along the direction from the cover 200 to the base 100, a fixing mechanism is provided at a bottom of the base 100, and the base 100 is connected to the wall through the fixing mechanism. By providing the fixing mechanism, the lighting device can be installed on the wall more conveniently and quickly, and the appearance is aesthetic.

The examples of the present disclosure provide a lighting device to solve the problem that the light source module is not easy for disassembly and installation.

An example of the present disclosure provides a lighting device, including: a base, a cover and a lighting module; the cover is disposed on the base, and a receiving chamber is formed between the cover and the base; the lighting module includes a light source module and a driving power source, the light source module is rotatably disposed on a side wall of the base, the driving power source is disposed in the receiving chamber, and the light source module is connected with the driving power source.

Optionally, in the above-described lighting device, the light source module includes a light source substrate and a rotatable support; one end of the rotatable support is rotatably disposed on the side wall of the base, and the other end of the rotatable support is snap-fitted with the side wall of the base; and the light source substrate is disposed on the rotatable support.

Optionally, in the above-described lighting device, in a direction from the cover to the base, the rotatable support includes a stepped double-ring structure in which an inner ring is recessed, and the light source substrate is disposed on the inner ring of the rotatable support.

Optionally, in the above-described lighting device, the rotatable support is disposed on the side wall of the base through a rotation shaft; a snap-fitting block is disposed on the side wall of the base opposite to the rotation shaft; the rotatable support is provided with a through hole, and the snap-fitting block is snap-fitted with the through hole.

Optionally, in the above-described lighting device, the snap-fitting block has an elastic structure.

Optionally, in the above-described lighting device, two snap-fitting blocks are provided; and/or, the snap-fitting block includes a pillar and a protrusion, one end of the pillar is disposed on a bottom wall of the base, the protrusion is connected to the pillar and is perpendicular to the pillar, and a bottom surface of the protrusion is slightly higher than the through hole so that the rotatable support is snap-fitted with the base.

Optionally, in the above-described lighting device, a plurality of light source elements is disposed on the light source substrate.

Optionally, in the above-described lighting device, the lighting module further includes at least one selected from the group consisting of: a sensor, an inverter, a wiring terminal, an adapter connector and a battery; the sensor, the inverter, the wiring terminal, the adapter connector and the battery are all disposed in the receiving chamber, and are all connected with the driving power source.

Optionally, in the above-described lighting device, a handle pulling member is disposed on the rotatable support to detach one end of the lighting module from the base.

Optionally, the above-described lighting device further includes a housing disposed outside the base to cover the base in a circumferential direction of the base.

Optionally, in the above-described lighting device, a fixing mechanism is disposed at a bottom of the base in a direction from the cover to the base, and the base is connected to a wall by the fixing mechanism.

Optionally, the above-described lighting device further includes at least one press-locking mechanism; one end of the press-locking mechanism is disposed on the cover or on the base, and the other end of the press-locking mechanism is rotatably locked on the base or on the cover; and the press-locking mechanism is configured to detachably connect the cover with the base.

Optionally, in the above-described lighting device, the press-locking mechanism includes a buckle and a snap-fitting slot, one end of the buckle is rotatably disposed on the base, and the snap-fitting slot is disposed on the cover; the cover is configured to be installed on the base by snap-fitting the other end of the buckle into the snap-fitting slot; and the cover is further configured to be detached from the base by rotating the buckle so that the buckle disengages from the snap-fitting slot.

Optionally, in the above-described lighting device, the press-locking mechanism includes a buckle and a snap-fitting slot, one end of the buckle is rotatably disposed on the cover, and the snap-fitting slot is disposed on the base; the cover is configured to be installed on the base by snap-fitting the other end of the buckle into the snap-fitting slot; and the cover is further configured to be detached from the base by rotating the buckle so that the buckle disengages from the snap-fitting slot.

Optionally, in the above-described lighting device, the buckle is evenly arranged on the cover along a circumferential structure of the cover; or the buckle is evenly arranged on the base along a circumferential structure of the base.

Optionally, in the above-described lighting device, four press-locking mechanisms are provided.

Optionally, in the above-described lighting device, at least two press-locking mechanisms are provided, and at least one positioning mechanism is disposed between two adjacent press-locking mechanisms; the positioning mechanism is configured to position a connecting part at which the cover and the base are connected.

Optionally, in the above-described lighting device, a positioning bracket is disposed on the cover or on the base, the positioning mechanism is a connecting member, one end of the connecting member is connected to the positioning bracket, and the other end of the connecting member is correspondingly connected to the base or the cover.

Optionally, the above-described lighting device further includes: a sealing ring disposed between the cover and the base, the press-locking mechanism presses against the sealing ring to position the sealing ring between the cover and the base.

Optionally, the above-described lighting device further includes a housing disposed outside the base and the press-locking mechanism to cover the base and the press-locking mechanism in a circumferential direction of the base and the press-locking mechanism.

The above-described examples of the present disclosure can achieve at least following advantageous effects:

The examples of the present disclosure disclose a lighting device, including a base, a cover and a lighting module; the lighting module includes a light source module and a driving power source; the light source module is rotatably disposed in a receiving chamber formed by the cover and the base. By rotating the light source module, the lighting module may be opened and closed, which has the advantages of easy disassembly and installation with more convenient and faster operation.

The description of the foregoing examples in this application is focus on the difference between various examples, and more example(s) can be obtained by combining different optimized features from various examples as long as there is no contradiction therebetween, without repeatedly described herein for the sake of conciseness of the text.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above are merely examples of the present disclosure, without construing any limitation to the present disclosure. For those skilled in the art, the present disclosure may have various modifications and changes. Any modification, equivalent replacement, improvement, etc. made within the spirit and principle of this application shall be included in the scope of the claims of this application.

What is claimed is:

1. A lighting device, comprising:

a base, a cover and a lighting module, wherein the cover is disposed on the base, and a receiving chamber is formed between the cover and the base; and the lighting module comprises a light source module and a driving power source, wherein the light source module is rotatably disposed on a side wall of the base, the driving power source is disposed in the receiving chamber, and the light source module is connected with the driving power source;

wherein the light source module comprises a light source substrate and a rotatable support, one end of the rotatable support is rotatably disposed on the side wall of the base, and the other end of the rotatable support is snap-fitted with the side wall of the base, and the light source substrate is disposed on the rotatable support; and wherein in a direction from the cover to the base, the rotatable support comprises a stepped double ring structure in which an inner ring is recessed, and the light source substrate is disposed on the inner ring of the rotatable support.

2. The lighting device according to claim 1, wherein a plurality of light source elements is disposed on the light source substrate.

3. The lighting device according to claim 1, wherein:

the lighting module further comprises one selected from the group consisting of: a sensor, an inverter, a wiring terminal, an adapter connector and a battery, and the sensor, the inverter, the wiring terminal, the adapter connector and the battery are all disposed in the receiving chamber, and are all connected with the driving power source.

4. The lighting device according to claim 1, wherein a handle pulling member is disposed on the rotatable support to detach one end of the lighting module from the base.

5. The lighting device according to claim 1, further comprising a housing disposed outside the base to cover the base in a circumferential direction of the base.

6. The lighting device according to claim 1, wherein:

a fixing mechanism is disposed at a bottom of the base in a direction from the cover to the base, and the base is connected to a wall by the fixing mechanism.

7. The lightening device according to claim 1, further comprising at least one press-locking mechanism, wherein one end or the press-locking mechanism is disposed on the cover or on the base, and the other end of the press-locking mechanism is rotatably locked on the base or on the cover, and the press-locking mechanism is configured to detachably connect the cover with the base.

8. The lighting device according to claim 1, wherein the rotatable support is disposed on the side wall of the base through a rotation shaft, a snap-fitting block is disposed on the side wall of the base opposite to the rotation shaft, and the rotatable support is provided with a through hole, and the snap-fitting block is snap-fitted with the through hole.

9. A lighting device, comprising:

a base, a cover and a lighting module, wherein the cover is disposed on the base, and a receiving chamber is formed between the cover and the base; and the lighting module comprises a light source module and a driving power source, wherein the light source module is rotatably disposed on a side wall of the base, the driving power source is disposed in the receiving chamber, and the light source module is connected with the driving power source;

wherein the light source module comprises a light source substrate and a rotatable support, one end of the rotatable support is rotatably disposed on the side wall of the base, and the other end of the rotatable support is snap-fitted with the side wall of the base, and the light source substrate is disposed on the rotatable support, and wherein the rotatable support is disposed on the side wall of the base through a rotation shaft, a snap-fitting block is disposed on the side wall of the base opposite to the rotation shaft, and the rotatable support is provided with a through hole, and the snap-fitting block is snap-fitted with the through hole.

10. The lighting device according to claim 9, wherein the snap-fitting block has an elastic structure.

11. The lighting device according to claim 9, wherein:

two snap-fitting blocks are provided; and/or, the snap-fitting block comprises a pillar and a protrusion, one end of the pillar is disposed on a bottom wall of the base, the protrusion is connected to the pillar and is perpendicular to the pillar, and a bottom surface of the protrusion is slightly higher than the through hole so that the rotatable support is snap-fitted with the base.

12. A lighting device, comprising:

a base, a cover, a lighting module, and at least one press-locking mechanism wherein the cover is disposed on the base, and a receiving chamber is formed between the cover and the base; and the lighting module comprises a light source module and a driving power source, wherein the light source module is rotatably disposed on a side wall of the base, the driving power source is disposed in the receiving chamber, and the light source module is connected with the driving power source; and wherein one end or the press-locking mechanism is disposed on the cover or on the base, and the other end of the press-locking mechanism is rotatably locked on the base or on the cover, and the press-locking mechanism is configured to detachably connect the cover with the base.

13. The lighting device according to claim 12, wherein:

the press-locking mechanism comprises a buckle and a snap-fitting slot, wherein one end of the buckle is rotatably disposed on the base, and the snap-fitting slot is disposed on the cover, the cover is configured to be installed on the base by snap-fitting the other end of the buckle into the snap-fitting slot; and the cover is further configured to be detached from the base by rotating the buckle so that the buckle disengages from the snap-fitting slot.

14. The lighting device according to claim 12, wherein:

the press-locking mechanism comprises a buckle and a snap-fitting slot, wherein one end of the buckle is rotatably disposed on the cover, and the snap-fitting slot is disposed on the base, the cover is configured to be installed on the base by snap-fitting the other end of the buckle into the snap-fitting slot; and the cover is further configured to be detached from the base by rotating the buckle so that the buckle disengages from the snap-fitting slot.

15. The lighting device according to claim 13 wherein the buckle is evenly arranged on the cover along a circumferential structure of the cover; or the buckle is evenly arranged on the base along a circumferential structure of the base.

16. The lighting device according to claim 12, wherein four press-locking mechanisms are provided.

17. The lighting device according to claim 12, wherein at least two press-locking mechanisms are provided, and wherein at least one positioning mechanism is disposed between two adjacent press-locking mechanisms, and the positioning mechanism is configured to position a connecting part at which the cover and the base are connected.

18. The lighting device according to claim 17, wherein a positioning bracket is disposed on the cover or on the base, the positioning mechanism is a connecting member, wherein one end of the connecting member is connected to the positioning bracket, and the other end of the connecting member is correspondingly connected to the base or the cover.

19. The lighting device according to claim 12, further comprising: a sealing ring disposed between the cover and the base, wherein the press-locking mechanism presses against the sealing ring to position the sealing ring between the cover and the base.

20. The lighting device according to claim 12, further comprising a housing disposed outside the base and the press-locking mechanism to cover the base and wherein the press-locking mechanism in a circumferential direction of the base and the press-locking mechanism.

* * * * *